United States Patent [19]

Yunker et al.

[11] 4,208,815

[45] Jun. 24, 1980

[54] STRAIGHT EDGE BLADE FOR INSTALLATION ON AN EARTH MOVING BUCKET

[75] Inventors: Julius R. Yunker; Jerrold R. Yunker, both of 100 West Rd., Pittsburgh, Pa. 15209

[73] Assignees: Julius Ralph Yunker; Jerrold Ralph Yunker; Charles E. Michael, all of Pittsburgh, Pa.

[21] Appl. No.: 914,154

[22] Filed: Jun. 9, 1978

[51] Int. Cl.[2] ..... E02F 9/28

[52] U.S. Cl. ..... 37/141 R; 37/142 R

[58] Field of Search ..... 37/141 R, 141 T, 142 R, 37/142 A, 117.5, 103, DIG. 3

[56] References Cited

U.S. PATENT DOCUMENTS

| | | | |
|---|---|---|---|
| 1,963,847 | 6/1934 | Jersey | 37/141 R |
| 2,285,039 | 6/1942 | Lowe | 37/141 R |
| 3,043,032 | 7/1962 | Discenza | 37/117.5 |
| 3,160,967 | 12/1964 | Nichols | 37/142 A |
| 3,469,330 | 9/1969 | Hood et al. | 37/141 R X |
| 3,765,109 | 10/1973 | Daviduke | 37/142 R X |
| 3,841,007 | 10/1974 | Howarth et al. | 37/141 R |
| 3,942,271 | 3/1976 | George | 37/117.5 |
| 3,995,384 | 12/1976 | Wood | 37/141 R |
| 4,043,060 | 8/1977 | Stepe | 37/141 R |
| 4,125,952 | 11/1978 | Jennings | 37/117.5 |

FOREIGN PATENT DOCUMENTS

| | | | |
|---|---|---|---|
| 2458361 | 12/1974 | Fed. Rep. of Germany | 37/142 R |

*Primary Examiner*—E. H. Eickholt

*Attorney, Agent, or Firm*—Auslander & Thomas

[57] ABSTRACT

A straight edge for an earth-moving bucket has pockets on a plate which engage the bucket teeth. The plate extends back to overlap the bottom of the bucket. The straight edge is held firm by bolts through the plate and bucket. The straight edge is no wider than the bucket so that it can function as a digging edge. The straight edge is installable by a single person in a short period of time and without assistance.

3 Claims, 4 Drawing Figures

FIG.1
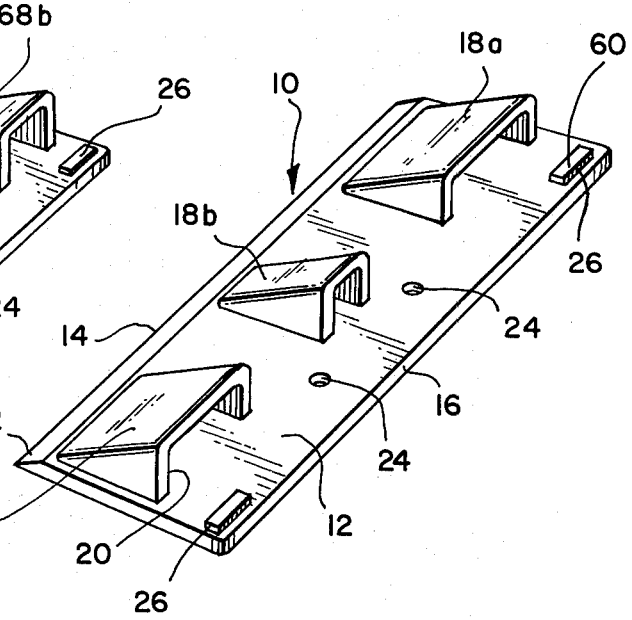
FIG.4
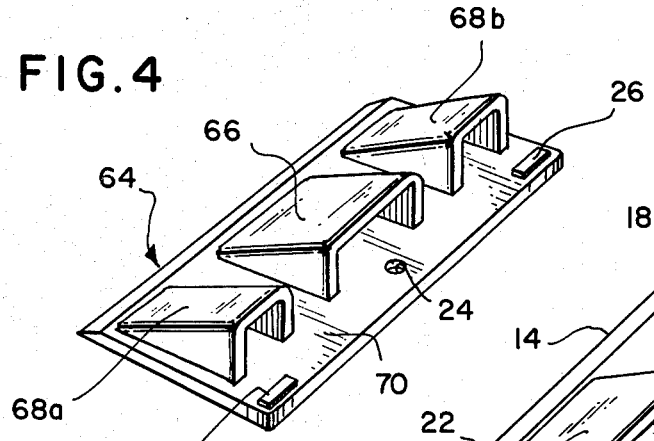
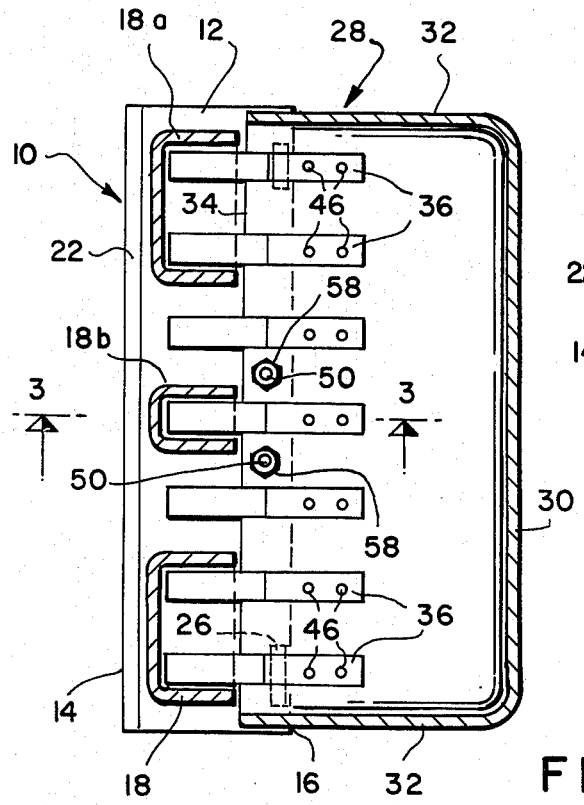
FIG.2
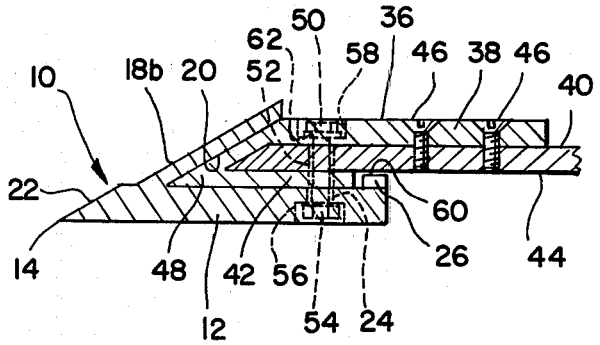
FIG.3

STRAIGHT EDGE BLADE FOR INSTALLATION ON AN EARTH MOVING BUCKET

The present invention relates to a straight edge blade for installation on an earth moving bucket.

The straight edge for the earth moving bucket comprises a blade with angled pockets on one side of a plate. The plate continues behind the bucket, shielding the back surfaces of the teeth from wear and providing a means for bolting the assembly to the bucket. Stress pads on the plate bear against the outside of the bucket both locking the assembly in position and resisting torsion.

Earth-moving equipment of the type having a movable bucket are conventionally equipped with bifurcated teeth projecting forward from the lower lip of the bucket. The bifurcated teeth are used for ripping and loosening the soil, rock, pavement or the like. The loosened material is picked up in the bucket by moving the lower edge of the bucket forward under the material, then generally tilting the bucket upward to secure it therein.

Numerous occasions arise when the bifurcated teeth interfere with operation of the bucket. The teeth, projecting below the lower lip of the bucket raise the lower lip of the bucket above the flat surface, such as a pavement. Consequently, it becomes more difficult, if not impossible to pick up and load finely comminuted material such as sand or gravel from a flat surface.

U.S. Pat. No. 3,362,554 teaches a manure-spreading bucket which has removable tines which fit into sockets in the bucket. A straight scoop can be substituted for the tines by removing the tines and fitting into the sockets, projections from the straight scoop to give a straight-edge bucket. The individual removal of tines and insertion and locking of the projections makes the change-over from one configuration to the other, a time-consuming process.

U.S. Pat. Nos. 3,160,967 and 3,765,109 employ sockets in the rear edge of a straight edge into which are fitted projections from the front edge of the bucket. Pins or bolts passing through holes in the sockets and projections hold the straight edge to the bucket. Neither of these patents provides for a rearward projection of the straight edge plate to protect the bottom surface of the teeth from wear. In addition, all of the stress on the straight edge is concentrated at the pins or bolts leading to rapid wear of the attachment devices.

U.S. Pat. No. 4,043,060 teaches inside reinforcements in a bucket which have shaped forward protecting ends. The forwardprojecting ends fit in pockets in either a straight edge or in a blade which carries teeth. As in previously mentioned configurations, pins or bolts passing through the pockets and the forward projections will hold the straight edge or toothed blade in place.

U.S. Pat. No. 3,043,032 teaches a blade which fits over the teeth of a bucket and is attached in place by arms which are bolted to the sides of the bucket.

The applicant has discovered a straight edge blade for a toothed bucket which overcomes the problems of cumbersome attachment, weakness and excessive wear of the devices in the prior art.

According to the teaching of the present invention, a flat plate of steel is arranged to fit along the bottom of the teeth attached to the bucket and extending both forward and rearward of the limits of the teeth. Angled pockets attached to the one face of the plate are arranged to fit the teeth and to provide most of the support against thrust of the blade.

The plate extends past the rear of the bottom of the teeth. A pair of stress pads near the rear of the plate fit behind the rear of the teeth and prevent the plate from being moved forward, as well as providing a hearing point against the outside of the bucket to absorb torsion forces. In the preferred embodiment, the stress pads are located behind the two teeth nearest the lateral ends of the bucket. These outside locations therefore permit maximum taking up of torsional forces which occur from engagement of the corner of the blade with a resisting object.

Since the plate shields the entire teeth, including that part which is below the lip of the bucket, the wear from scraping which ordinarily reduces the lifetime of teeth, is taken entirely by the plate.

The assembly is held in place by one or more bolts which pass through the plate and the bucket between the teeth. The bolts are required to bear almost no stress since the forces set up in use are distributed to the teeth by the pockets and to the bucket by the stress pads and the overlap of the assembly along the entire width of the bucket against the teeth. This construction also limits unnecessary torsion in the assembly in use.

Due to the construction of the present invention, the installation of even a large straight edge can be performed by a single installer. The straight edge is laid on a flat surface with the pockets uppermost and the teeth of the bucket are inserted into them as by moving the vehicle attached to the bucket forward until the teeth are engaged in pockets. Thereupon, the bucket can be rotated into the upward position which picks up the straight edge and causes the pockets to seat firmly upon the teeth. The installer then aligns the holes and he inserts one or more bolts which, when tightened, hold the assembly in place.

Although such novel feature or features believed to be characteristic of the invention are pointed out in the claims, the invention and the manner in which it may be carried out may be further understood by reference to the description following and the accompanying drawings.

FIG. 1 shows one embodiment of the present invention adapted for use with a seven-toothed bucket.

FIG. 2 shows a top view of the embodiment of FIG. 1 installed on a seven-toothed bucket.

FIG. 3 is a cross section of pocket and tooth taken along 3—3 of FIG. 2.

FIG. 4 shows a second embodiment of the invention adapted for installation on a four-toothed bucket.

Referring now to the figures in greater detail, where like reference numbers denote like parts in the various figures.

Referring now to FIG. 1, there is shown, generally at 10, an embodiment of the invention.

A plate 12 having a forward edge 14 and a rear edge 16 has attached to the upper surface thereof, a plurality of angled pockets 18. The pockets 18 are attached to the plate by conventional means such as by welding. The pockets 18 have openings 20 and generally a triangular cross section.

The forward edge 14 of the plate 12 is optionally beveled as at 22 to improve the cutting and scraping action of the blade.

The pockets 18 and 18*a* may be wide enough to each accommodate two or more teeth or some or all of the pockets 18 be suitable to accommodate only a single tooth.

Mounting holes 24 are provided through the plate 12. The mounting holes 24 are arranged to be offset from the teeth as will be explained. At least two stress pads 26 are located along the surface of the plate 12 near the rear edge 16. The stress pads 26 are positioned to be aligned with the outside teeth, but behind the rear of the bottom of the teeth. Although the stress pads 26 are shown as two discrete stress pads, the three, four or more stress pads 26 may be employed along the rear edge 16 of plate 12, or a continuous strip may be substituted for stress pads 26. In the locations shown, the two stress pads are especially adapted to torsional forces from the corners of the blade to the most rigid part of the bucket. Consequently, use of two stress pads 26 as shown in the preferred embodiment.

Referring now to FIG. 2, the straight edge 10 is shown actively connected to a seven-toothed bucket 28 of an earth-moving machine (not shown). The bucket 28 has a rear wall 30, two sides walls 32 and a forward lip 34. A plurality, for example, seven bifurcated teeth 36 are attached to the lip 34, projecting into the bucket 28 and projecting forward of the forward lip 34.

Referring momentarily to FIG. 3, the bifurcated teeth 36 has an upper plate 38 which fits atop the floor 40 of the bucket 28 and a lower plate 42 which passes under the floor 40 and bears against the outer surface 44 of the bucket 28. The tooth 36 is secured to the floor 40 by conventional means such as welding, riveting or by bolts 46 through the upper plate 38 and the floor 40. Conventionally, the upper plate 38 is longer than lower plate 42 and therefore extends further back into the floor 40 of the bucket 28. This provides a larger surface area of contact between the upper plate 38 and the floor 40 for distributing the stresses from the tooth 36 to the bucket 28.

As installed, the point 48 of the tooth 36 fits into the angled pocket 18 with the stress pad 26 lying behind the rear of the lower plate 42 and engagable with the other surface 44 in that position when the plate 12 is drawn snugly against the bottom of the lower plate 42.

A mounting bolt 50, shown in dashed line, passes through the mounting hole 24 in the plate 12 and mounting hole 52 in the floor 40 of bucket 28 herein. The head 54 of mounting bolt 50 is protected in a countersink 56 in the plate 12. This protection for the head 54 conveniently extends the life of the mounting bolt 50. The head 54 would otherwise be rapidly ground off by the abrasion with the pavement or the earth during operation of the earth-moving device. A nut 58 on the mounting bolt 50 bolts the plate 12 into contact with the outer surface 44 of the bucket 28. In particular, the bolt pulls the upper surface 60, the stress pads 26 into bearing contact with the outer surface 44 of the bucket 28.

As thus arranged, little or no forces are borne by the mounting bolt 50 during normal operation of the earth-moving equipment. Most of the forces on the straight edge 10 are either rearward or forward as shown. These forces are taken up by the contact between the pocket 18*b* and the point 48 as well as the contact between the upper surface 60 of the stress pad 26 and the outer surface 44 of the bucket 28, also the plate 12 is supported along the lower plates 42 of the teeth 36. The main force which mounting bolt 50 is called upon to withstand, is that upward in the figure on the forward edge 14 of the straight edge 10. This force is normally negligible.

A washer 62 may optionally be employed under nut 58. In the sequence of installing the straight edge 10 on the seven-tooth bucket 28 as shown in FIG. 2, one of the two mounting bolts 50 may first be installed in one of the mounting holes 24 and the nut 58 drawn up to align the second mounting hole 24 and to pull the stress pad 26 into contact with the outer surface 44 of the bucket 28. In order to make it easier to thread the first nut 58, the first installed mounting bolt 50 may be slightly longer than required. After pulling tight, the first mounting bolt nut 58, the second mounting bolt 50 may be inserted through the second mounting hole 24 and pulled tight with the nut 58. In order to avoid peening of the threads of the mounting bolt 50, protruding through the nut 58, the mounting bolt 50 is preferably short enough so that none of the threads protrude. If the first mounting hole 50 should be long enough to cause the threads to protrude through the nut 58, the optional washer 62 may be used. In this case, after the second mounting bolt 50 is drawn tight by the nut 58, the nut 58 on the first installed mounting bolt 50 is removed and the washer 62 installed thereafter, the nut 58 is reinstalled over the washer 62 on the first mounting bolt 50 and drawn tight. The extra thickness of the washer 62 ensures that the threads of the first installed mounting bolt 50 remain inside the nut 58.

As can be seen in FIG. 2, not all of the teeth 36 are necessarily encased in pockets 18. For example, the third and fifth teeth from the end in the seven-toothed bucket of FIG. 2 are not enclosed in pockets 18. Optionally, however, the third and fifth teeth of the configuration shown in FIG. 2 may be enclosed in pockets without departing from the scope of the invention.

Referring now to the embodiment shown in FIG. 4, the straight edge shown generally at 64 is adapted for use with a four-toothed bucket (not shown). In this embodiment, a center pocket 66 is sized to accommodate the two center teeth on the bucket, and two outside pockets 68*a*, 68*b* are sized to accommodate a single tooth each. A single tooth each. A single mounting hole 24 is centrally located near the rear edge of the blade 70. The location of the mounting hole 24 places it between the two center teeth of the bucket (not shown).

Installation of the straight edge 64 on its associated bucket is similar to the embodiment shown in FIG. 2, except only a single mounting (not shown) is employed.

As it will be evident to one skilled in the art, a straight edge according to the present invention can be used with earth-moving buckets having any number of teeth and the invention not be construed as being limited to the seven tooth or four tooth examples used in the present description.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. An easily attachable and removable digging straight edge for installation on an earth mover bucket of a type having a plurality of bifurcated forward pointed teeth straddling the lower lip thereof and said teeth including an upper and lower plate comprising, a plate, said plate no longer than the width of said bucket, at least one pocket means on one face of said plate for fitting on a plurality of said teeth, said plate extending forward and rearward of said lower plate of said teeth, stress pad means on said plate behind the lower plate of said teeth for bearing against the outer surface of said bucket, said stress pad means at least at the longitudinal ends of said plate, means for holding said plate against said lower plate of said teeth, and said holding means comprising at least one opening in said plate; at least one opening in said bucket between a pair of said teeth; a countersink in the outside of said plate surrounding said opening; and nut and bolt means through said openings holding said plate and said bucket tightly engaged; said nut and bolt means engaged at one end in said countersink and at another end in said bucket; no portion of said bolt means extending beyond said nut means when said nut and bolt means are engaged and said other portion protected by said countersink.

2. The invention of claim 1 including a plurality of pockets.

3. The invention of claims 1 or 2 wherein said at least on pocket substantially matches the shape of said bucket teeth.

* * * * *